United States Patent [19]

Fratturo

[11] 4,074,875

[45] Feb. 21, 1978

[54] TEXTILE CARRIER

[75] Inventor: Jules P. Fratturo, Greenville, S.C.

[73] Assignee: Textube Corporation, Greer, S.C.

[21] Appl. No.: 688,733

[22] Filed: May 21, 1976

[51] Int. Cl.[2] ..... B65H 75/30; B65H 75/10

[52] U.S. Cl. ..... 242/118.3; 242/46.21

[58] Field of Search ..... 242/118.32, 118.31, 242/118.3, 118.11, 118.1, 118.2, 118, 118.7, 46.21, 46.2, 46.3, 46.4; 57/129, 131, 132

[56] References Cited

U.S. PATENT DOCUMENTS

| | | | |
|---|---|---|---|
| 1,652,601 | 12/1927 | Blair | 242/118.3 |
| 2,419,415 | 4/1947 | Morf | 242/118.31 |
| 3,454,235 | 7/1969 | Hurley | 242/118.32 X |
| 3,534,917 | 10/1970 | Blake | 242/118.3 X |

*Primary Examiner*—George F. Mautz

*Attorney, Agent, or Firm*—Wellington M. Manning, Jr.; Luke J. Wilburn, Jr.

[57] ABSTRACT

An improved textile carrier is described and disclosed herein for improved spinning stability at high speeds and includes a molded plastic barrel having an outside taper inwardly from a large bottom end to a smaller upper end, with the outside surface of the barrel preferably having a texture to properly receive yarn therearound. The inside diameter of the barrel varies from bottom to top and has a section located intermediate the length of the barrel to properly receive and position a driven spindle therein and to provide stability along the length of the barrel at high spinning speeds. An approximately constant clearance is provided between the spindle and the barrel substantially along the length of the intermediate section. In a preferred arrangement, the intermediate section is made up of a plurality of ribs of unitary construction with the inside wall of the barrel, being equally spaced therearound. The preferred ribs have a taper at a lower end of same to the point of clearance with the spindle and present a flat surface parallel with the spindle for the remainder of the length of same upwardly along the barrel, said ribs reducing in thickness at a rate corresponding in degree to the taper of the outside wall of the barrel. Metallic ferrules may also be provided at the lower end of the barrel to permit a magnetic attachment at the spindle base, and at the upper end of the barrel.

6 Claims, 3 Drawing Figures

TEXTILE CARRIER

BACKGROUND OF THE INVENTION

Textile carriers of wide and varied design and dimension have been known in the art for many years. Many of these carriers are tapered tubes that have been produced from wood, wrapped paper, molded plastic, metal and the like. Likewise, certain of these prior tubes have been produced with features that permit specialized handling; lend susceptibility to a particular operation; or permit attainment of certain advantages above and beyond conventional tapered tubes.

Primary with all textile carriers is the ability to have a uniform yarn package produced therearound which, once produced, may be properly removed for subsequent formation of fabric, twisting, winding or other yarn processing. Moreover, the carrier should be capable of placement on the textile frame and removal therefrom in a convenient, uniform and efficient fashion. Each of these dictates or carrier characteristics seems simple enough. Actual conditions, however, wich include human mishandling errors during doffing and donning; repeated use of the carriers; and the like, bring about realization of the need of the aforementioned carrier characteristics. Particular problems have been encountered with molded spinning tubes where high speeds, above 12,000 revolutions per minute, for example, are encountered. Conventional molded plastic tubes tend to distort along the medial portions of same when experiencing high rotational speeds on a spindle. It has thus become encumbent upon one to attempt to provide a textile carrier which incorporates as many of the needed characteristics as possible to improve the textile carriers while avoiding structures that afford improvement in one area while creating problems in a further area or during a further yarn process step.

The textile carrier of the present invention represents an improvement over conventional molded carriers. While certainly there are possibilities of mishandling and misuse of the carriers to the point of malfunction during use, the present textile carrier does represent an improvement over the prior art carriers and also avoids known shortcomings of the prior art alluded to above.

SUMMARY OF THE INVENTION

It is an object of the present invention to provide an improved textile carrier.

Another object of the present invention is to provide an improved molded textile carrier that may be drop fitted onto a textile spindle by automatic doffing-donning equipment and which remains stable againt distortion at high spindle speeds.

Yet another object of the present invention is to provide an improved textile carrier which during use, properly seats at the spindle base, and receives a yarn package therearound without any appreciable inertial distortion of the carrier during high speed spinning.

Generally speaking, the textile carrier of the present invention comprises a plastic barrel, said barrel having an outside wall with an inward taper from a lower end of an upper end thereof, said barrel further having an inside wall with positioning means located partially along an intermediate portion of the length thereof, said positioning means beginning along said inside wall inwardly from said lower end and having an inward taper upwardly along said barrel to a point where a predetermined clearance is provided around a spindle to be received thereat, the remainder of the length of said positioning means being substantially parallel with said spindle, the thickness of said means diminishing at a rate approximately the rate of taper of said outside wall, said means diminising at a point adjacent and below an area where said spindle tip will reside when said carrier is received therearound.

More specifically, the textile carrier of the present invention is molded from a plastic material whereby very close dimensional tolerance is realized. In a preferred embodiment, the means located partially along the inside wall of the barrel are a plurality of inwardly projecting ribs, a lower end of which define a guide surface for placement of the carrier onto the spindle and the remainder of the length of which are parallel along a top of same to the outside of the spindle to be received therein. A substantially constant clearance is thus provided between the spindle and the ribs along a medial portion of the carrier which improves the dimensional stability of the carrier at high spinning speeds without adding excess weight thereto.

Wall thickness of the barrel between the inside and outside walls is generally constant with the outside wall having an inward taper from the lower to an upper end of same as mentioned supra. Normally the inside wall of the carrier has a similar taper. According to the present invention, the internal ribs, solid section or other structural positioning means compensate for taper of the inside wall and reinforce the carrier while providing a substantially constant clearance between the spindle and the barrel along a substantial portion of the length of the carrier. The internal positioning means thus begin along the inside wall away from the upper end, at a point just below an area where the spindle tip will be received, and increase in thickness at a rate similar to the rate of taper of the outside wall of the barrel. The positioning means terminate a sufficient distance from the bottom of the barrel to permit proper placement of same onto a spindle and later use of same in other processes, such as winding. A tapered thinning of the means is present to provide a taper for self centering of the spindle during the donning operation.

DESCRIPTION OF THE PREFERRED EMBODIMENTS

Figure 1:
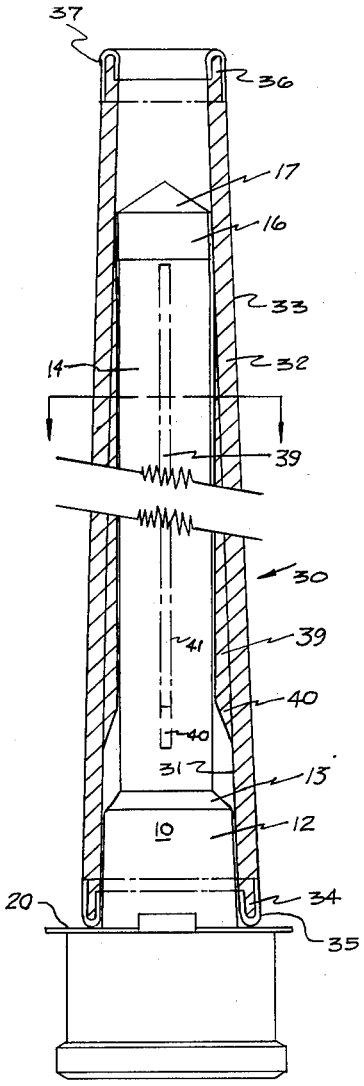
FIG. 1 is a side elevational, cross sectional view of a textile carrier according to the present invention positioned around a textile spindle.

Making reference to the Figures, preferred embodiments of the present invention will now be described in detail. A textile spindle 10 is shown in FIG. 1 having a base 12 which may include magnetic attraction means 20 thereat, including a magnet (not shown) positioned around base 12 to provide a magnetic force attraction on a textile carrier 30 as will be described hereinafter in more detail. A textile carrier generally indicated as 30 is received in driving relationship on spindle 10 for the production of a yarn package therearound. Base 12 has an inward tapered portion 13 at an upper end thereof to assist in mounting yarn carrier 30 thereon. Above spindle base 12 is an elongated body portion 14 having virtually no taper thereto and atop which is located a spindle tip 16 which tapers slightly inwardly and then terminates at an apex 17. Spindle 10 is mounted for driven rotary motion in conventional fashion on a portion of a textile spinning frame or the like. Particular mounting and the drive means for the spindle are not illustrated at this point since they do not form a part of the present invention.

Figure 2:
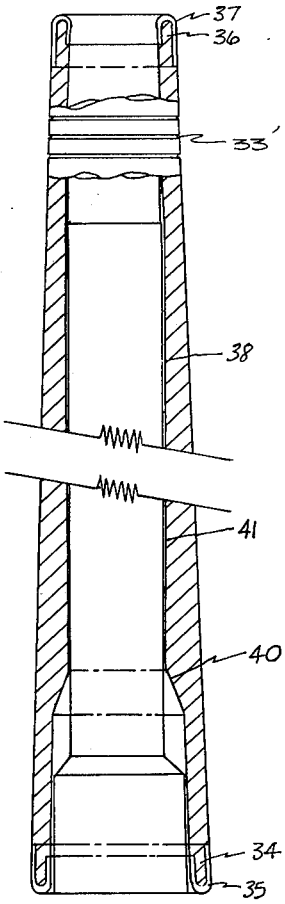
FIG. 2 is an elevational view in partial cross section of a textile carrier according to the teachings of the present invention and illustrating a further embodiment of same.

Textile carrier 30 comprises a molded plastic barrel 32 having a lower end 34 and an upper end 36. Barrel 32 along an outer surface thereof tapers inwardly from lower end 34 to upper end 36 at a generally constant rate to permit production of a proper yarn package therearound. As illustrated in FIG. 2, the outer wall 33 of barrel 32 along at least a major portion of the length thereof, is provided with a plurality of shallow indentions 33' which are representative of means to improve yarn placement therearound. Yarn being wrapped around carrier 30 thus does not slip appreciably along outside wall 33. As further illustrated in FIGS. 1 and 2, ferrules 35 and 37 may be provided at upper and lower ends 34 and 36 respectively. Bottom ferrule 35 preferably represents a metal section of carrier 30 that receives the magnetic force attraction from magnetic force attraction means 20 if same is employed with spindle 10, whereby carrier 30 is securely held on spindle 10. Both ferrules 35 and 37 are preferably metal for the sake of uniformity and aesthetics.

Inside wall 31 of carrier 30 is important according to the present invention. A smooth juncture is provided between metal ferrule 35 and inside wall 31 of barrel 32. There is thus a similar inside taper along inside wall 31 of barrel 32 from lower end 34 upwardly to upper end 36 except as described below. Spindle 10, as illustrated in FIG. 1, is straight between base 12 and tip 16 whereby the clearance therealong with the carrier would vary with prior art carriers. According to the present invention, however, a positioning means 38 is secured to inside wall 31 along a portion of the length of same and projects radially inwardly therefrom. Positioning means 38, as described in detail hereinafter, stabilizes carrier 30 during high speed rotation of same.

Positioning means 38 as illustrated in FIG. 2 is solid while in FIG. 1 the positioning means is represented by a plurality of axially extending ribs 39 which are preferred. Hereafter, positioning means 38 will be described as ribs 39, though all features are common to both. Ribs 39 begin at inside wall 31 a sufficient distance above lower end 34 of barrel 32 to permit ease of mounting of carrier 30 onto a spindle 10, or other yarn processing equipment. Initially ribs 39 taper from inside wall 31 inwardly at rib section 40 to define a guiding means for automatically centering spindle 10 within the positioning means 38 without extra effort by an operator. At a point where all ribs 39 define a distance therebetween to receive a spindle 10, leaving a desired clearance, ribs 39 present a flat inner surface 41 adjacent spindle 10. To continue the flat surface adjacent straight section 14 of spindle 10, ribs 39 get thinner in the direction of upper end 36 of barrel 32, corresponding in rate of decrease in thickness to the rate of taper of outside wall 33 of barrel 32. Ribs 39 could, however, be interrupted along their length such that only the inner surface of same is parallel to spindle 10 thereat. Flat rib sections 41 thus produce an untapered area along which straight portion 41 of spindle 10 resides, with ribs 39 terminating just short of the point where spindle tip 16 resides.

Positioning means 38, whether solid or ribbed or otherwise, increases the rigidity of carrier 30 along the length of same whereby during high speed rotation of same on a spindle 10, inertial forces will not cause barrel 32 to distort. Also with a substantially constant close clearance along straight portion 14 of spindle 10, there is much less room for movement during building of the package.

Figure 3:
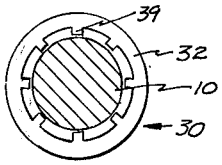
FIG. 3 is a horizontal cross sectional view of a textile carrier according to the present invention taken along a line III—III in FIG. 1.

FIG. 3 shows a horizontal cross sectional view through carrier 30 and illustrates ribs 39 positioned around spindle 10 along straight portion 14 of barrel 32. FIG. 1 shows eight such ribs 39. Obviously any number of ribs may be employed so long as they are equally spaced around inside wall 31.

Care must be taken in the molding of the carrier of the present invention to achieve the critical tolerance limits desired and to permit attainment of the improved results incident thereto. For example, it is desirable to drop fit carriers 30 around spindle 10 and achieve a good driving fit. An operator, or automatic donning apparatus should only position the lower end 34 of carrier 30 over the top of spindle 10 and release the carrier. As the carrier falls, section 40 of positioning means 38 guides same along spindle 10, and centers the carrier 30 around spindle 10.

The carrier of the present invention may be produced from any plastic material that affords the requisite structural stability at the rotational speeds of the spindle, will withstand the rigors of continued use, and will not collapse with yarn wound therearound. Suitable plastic materials for producton of the present carrier include, but are not limited to polypropylene, polyethylene, acrylonitrile-butadiene-styrene, and the like. Also in a preferred arrangement, positioning means 38 is of unitary construction with barrel 32.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. A textile carrier comprising a plastic barrel, said barrel having an outside wall surface that tapers inwardly from a lower end of same to an upper end of same, and an inside wall surface, said inside wall surface defining a spindle receiving opening through said barrel; a plurality of equally spaced, axially extending ribs secured to and arcuately spaced around said inside wall surface along a portion of the length of said barrel only, said ribs extending radially inwardly from said inside wall surface and defining a spindle receiving area therebetween, said ribs having an initial inward taper beginning above a lower end of said barrel to the spindle receiving area of said opening and thereafter presenting an inner surface that is substantially parallel with a spindle thereat, said ribs terminating at an area adjacent and below said upper end of said barrel where a spindle tip would reside within said barrel; and a metal ferrule located on at least one end of said barrel.

2. A textile carrier comprising a barrel, said barrel having an outside wall surface tapering inwardly from lower to upper end thereof and an inside wall surface correspondingly tapering inwardly from lower to upper end whereby the wall of said barrel is of generally uniform thickness throughout its length, and spindle positioning means comprising a plurality of spaced ribs on said inside wall surface extending longitudinally of said barrel and originating at a predetermined distance from said lower end, each of said ribs having a first portion tapering inwardly from said inside wall surface and thereafter a second portion extending generally parallel to the longitudinal axis of said barrel to a point of termination flush with said inside wall surface at a predetermined distance below the upper end of the barrel, whereby said positioning means closely surround a spindle to be received in said barrel to stabilize said textile carrier thereon during a wnding operation.

3. A textile carrier as defined in claim 2 wherein said ribs are equally spaced around said inside wall surface.

4. A textile carrier as defined in claim 2 wherein said barrel has a metal ferrule secured to an end thereof.

5. A textile carrier as defined in claim 4 wherein said barrel has a metal ferrule secured to each end thereof.

6. A textile carrier as defined in claim 2 wherein said positioning means and said barrel are of unitary construction.

* * * * *